United States Patent [19]

Seino et al.

[11] 4,311,777

[45] Jan. 19, 1982

[54] METHOD FOR FORMING AN ELECTROSTATIC LATENT IMAGE

[75] Inventors: Kuniki Seino, Aichi; Yoshihiro Ozaki, Isehara, both of Japan

[73] Assignee: Minolta Camera Kabushiki Kaisha, Osaka, Japan

[21] Appl. No.: 26,484

[22] Filed: Apr. 2, 1979

[30] Foreign Application Priority Data

Apr. 11, 1978 [JP] Japan ..... 53-42936

[51] Int. Cl.[3] ..... G03G 13/22

[52] U.S. Cl. ..... 430/48; 430/55; 430/126

[58] Field of Search ..... 96/1 R, 1 TE; 430/50, 430/48, 81; 361/212, 225

[56] References Cited

U.S. PATENT DOCUMENTS

| | | | |
|---|---|---|---|
| 2,825,814 | 3/1958 | Walkup | 250/49.5 |
| 2,904,431 | 9/1959 | Moncrieff-Yeates | 430/48 |
| 2,937,943 | 5/1960 | Walkup | 96/1 |
| 3,057,719 | 10/1962 | Byrne et al. | 430/48 |
| 3,322,539 | 5/1967 | Redington | 430/50 |
| 3,502,408 | 3/1970 | Brodie | 355/16 |
| 3,598,579 | 8/1971 | Robinson | 96/1 R |

FOREIGN PATENT DOCUMENTS 51-122450 10/1976 Japan ..... 355/14

*Primary Examiner*—John D. Welsh
*Assistant Examiner*—John L. Goodrow
*Attorney, Agent, or Firm*—Wolder, Gross & Yavner

[57] ABSTRACT

A method of producing an electrostatic latent image of an original includes the successive steps of positioning of face-to-face virtual contact a photoconductor layer superimposed on a conductive backing electrode and a dielectric layer superimposed on another conductive backing electrode, applying a direct current voltage of a first polarity between the electrodes of a value to produce gas discharges between the layers to charge the dielectric layer while the photoconductor layer is unexposed to any light, short circuiting the electrodes while exposing the full surface of the photoconductor layer to light until the electric field across the photoconductor layer is substantially zero and applying a voltage between the electrodes at a polarity opposite to the first polarity while exposing the photoconductor layer to the light image of an original. The dielectric layer may be a coating on a conductive copy paper or may be a driven endless conductive belt along which are located an image developing device, an image transfer device and a device for erasing residual toner and charges from the belt dielectric layer.

13 Claims, 15 Drawing Figures

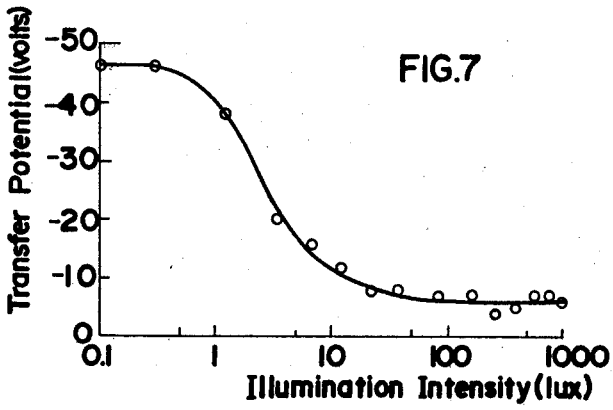
FIG.8
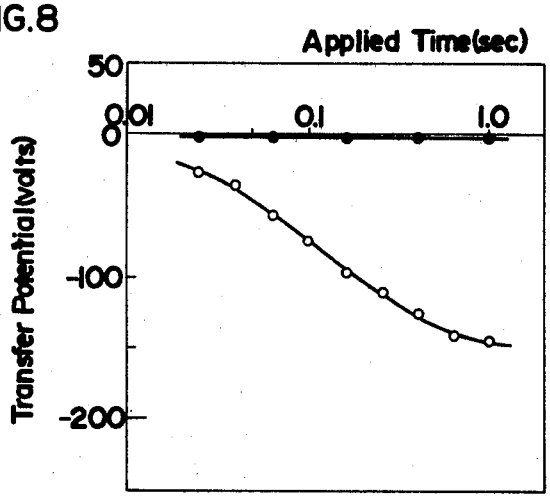
FIG.9
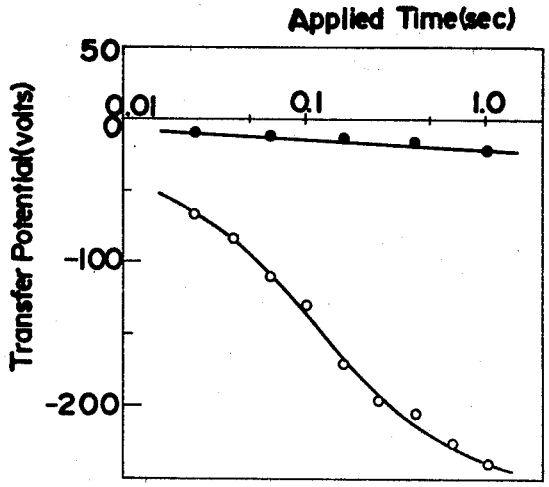

METHOD FOR FORMING AN ELECTROSTATIC LATENT IMAGE

The present invention relates generally to improvements in simultaneous charge transfer methods and electrostatic latent image transfer methods in which an electrostatic latent image is transferred by the simultaneous application of a voltage and exposure to a light image, and it relates more particularly to an improved method for forming an electrostatic latent image capable of producing a copy of high quality and free of fog by uniformly charging the surface of a latent image receiving dielectric member with charges opposite to the polarity of electrostatic latent image.

A simultaneous charge transfer method is described in U.S. Pat. No. 2,825,814, issued Mar. 4, 1958, in which method there is employed a photosensitive member including a photoconductive layer on a light transparent electrode plate (normally a NESA treated glass plate) and an electrostatic charge receiving dielectric member in the form of a belt including a few micron thick layers of a highly insulative dielectric material superimposed on a flexible conductive electrode.

The surface of the photoconductive layer of the photosensitive member is firmly held in face-to-face or facewise virtual contact with the surface of the belt dielectric layer, a direct current voltage of 500 to 1000 volts is then applied between the light transparent electrode plate of the photosensitive member and the conductive flexible electrode simultaneously with the projection or exposure of a light image onto the back of the photosensitive member whereby to form an electrostatic latent image on the surface of the dielectric layer. Further, the use of electrostatic transfer paper in which a dielectric layer of high resistivity is coated onto an electroconductive layer of high resistivity instead of the dielectric belt is described in U.S. Pat. No. 3,502,408, issued Mar. 24, 1970.

Among the advantages and features of the simultaneous charge transfer process are that a positive latent image can be formed from negative original, that a latent image can be formed in a very short period of time without requiring many steps, and that a high voltage source in the order of a couple of thousand volts such as for a corona discharge device is not required. On the other hand, there is the disadvantage such that transfer efficiency with an air gap of less than 5$\mu$ or over 40$\mu$ between the photoconductive layer and the charge receiving dielectric layer markedly deteriorates so that the normal techniques utilized to effect the fact-to-face contact between the photosensitive member and the dielectric member results in heavy blurs in the image density of the final image. To avoid this, the level of voltage applied may be increased so that the photosensitivity is increased to reduce blurs in the image density. However, this causes non-illuminated areas, i.e., background areas of the image, to become charged thereby rendering the final copy foggy.

There have been various methods proposed for solving the aforesaid drawbacks. A first method is to maintain a uniform air gap between the photosensitive member and the dielectric member by inserting a plurality of plastic balls of a few microns in diameter, therebetween in scattered fashion, in the manner described in U.S. Pat. No. 2,825,814. A second method is to apply a biasing voltage to the developing electrode at the time of development so far as to lower the fog density of the image as described in Japanese Laid Open Patent Application 51-122450. A third method includes the step of pre-charging the dielectric member prior to the image forming step as described in U.S. Pat. No. 2,937,943 issued May 24, 1960 and this is effected by applying simultaneously with full illumination of the photosensitive member a voltage of a polarity opposite to that of the voltage applied at the time of image exposure, and a fourth method as described in Japanese Patent Publication SHO 51-29019 includes applying a voltage of opposite polarity in the dark after the formation of the latent image so as to reduce the fogging of the image.

However, each of these methods are disadvantageous in that in the first method the photoconductive layer as well as dielectric layer tend to become damaged by the plastic balls and handling of these plastic balls are troublesome; that in second method, some means are required to apply a biasing voltage to the developing electrode and also that the electrode easily becomes soiled; that in the third method, the illumination intensity of the photosensitive member must be adjusted to be uniform in order to uniformly charge the dielectric member and that the applied voltage, intensity of illumination and the amount of time the voltage is applied must be accurately controlled and maintained in order to always charge the dielectric member to a constant surface potential; and that in the fourth method, fogging is not completely prevented but still remains to a certain undesirable extent and additionally, the step of applying the voltage in the dark cannot be performed until any influence from the light used to expose the original is completely eliminated.

SUMMARY OF THE INVENTION

It is accordingly a primary object of the present invention to provide an improved simultaneous charge transfer method for producing an electrostatic latent image which method overcomes the aforesaid drawbacks.

Another object of the present invention is to provide an improved method for forming an electrostatic latent image which is free of fog and is uniform quality.

Still another object of the present invention is to provide an improved method for forming an electrostatic latent image which can be performed in relatively simple and quick manner.

The above and other objects of the present invention are achieved by utilizing an improved simultaneous charge transfer process for producing an electrostatic latent image on an electrostatic charge receiving dielectric member held in virtual contact with a photosensitive member which process comprises a first step of applying a direct current voltage between the photosensitive member and the dielectric member under dark or non-illuminated conditions, the applied voltage being of sufficient value to cause air breakdown discharges in the air gap between the dielectric and photosensitive members even under dark conditions; a second step of short-circuiting the photosensitive member and the dielectric member and exposing or illuminating the photosensitive member until the electric field thereon becomes substantially zero; and a third step of applying a voltage between the photosensitive and dielectric members simultaneously with the exposure of the photosensitive member to a light image.

For a fuller understanding of the nature and objects of the present invention, reference is made to the following detailed description taken in conjunction with the accompanying drawings.

Figure 2A:
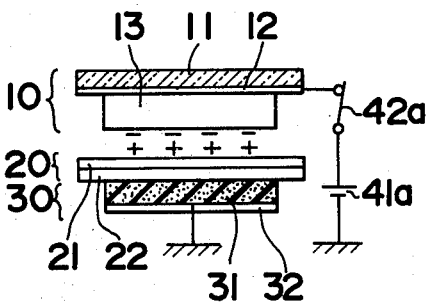
Figure 2B:
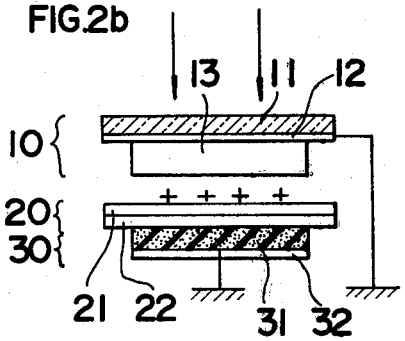
Figure 2C:
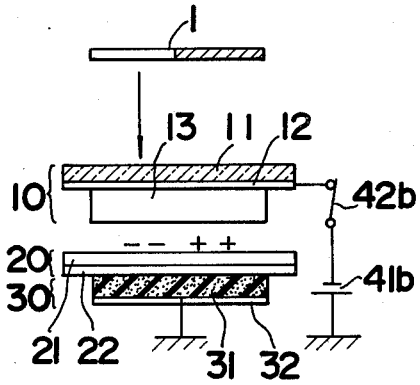
Figure 3:
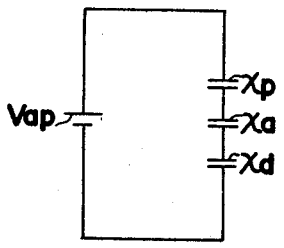
Figure 4:
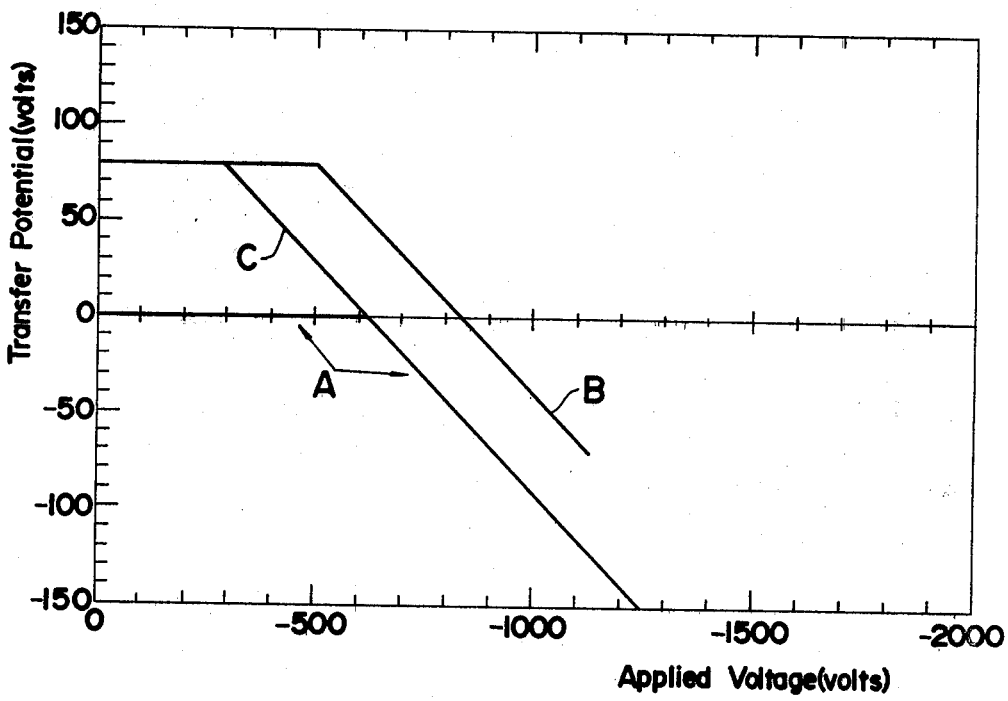
Figure 5:
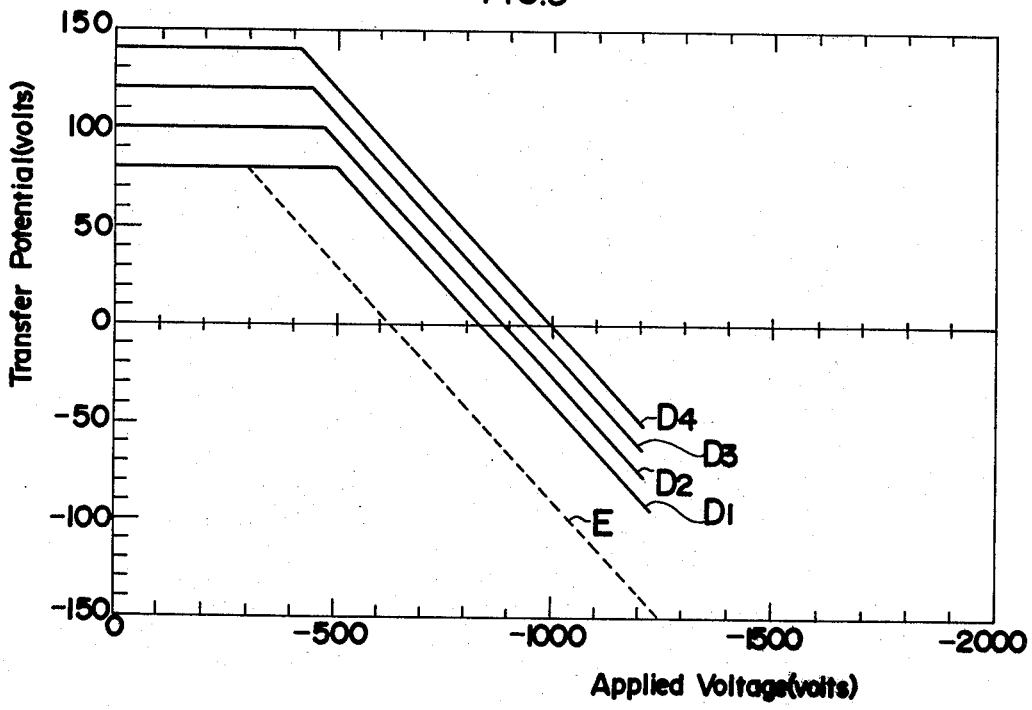
Figure 6:
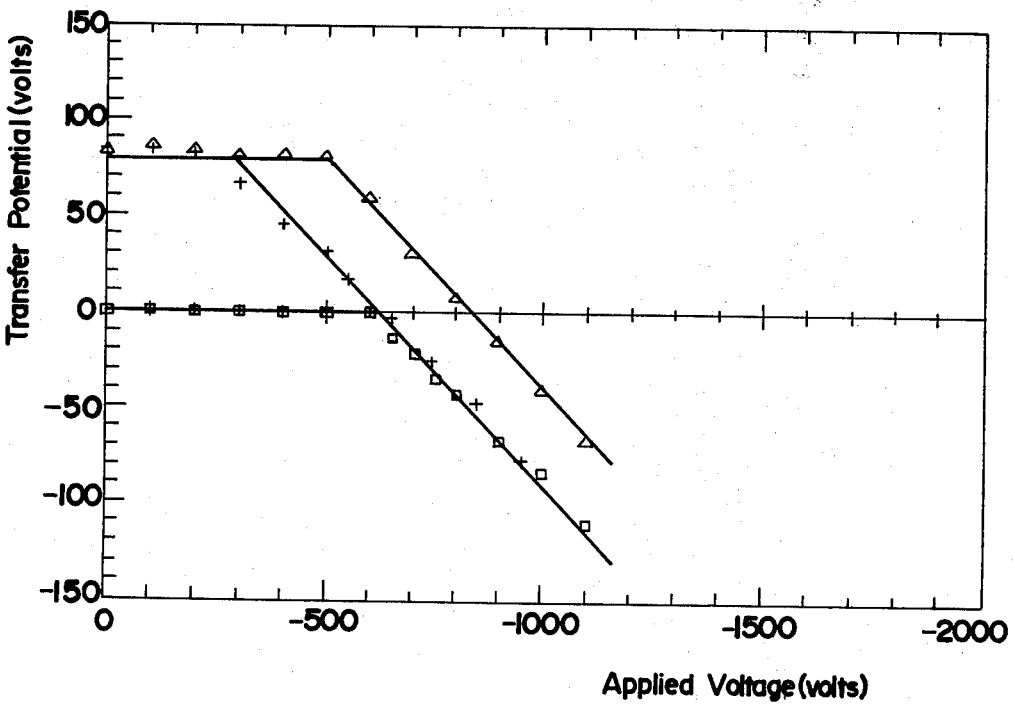
Figure 12:
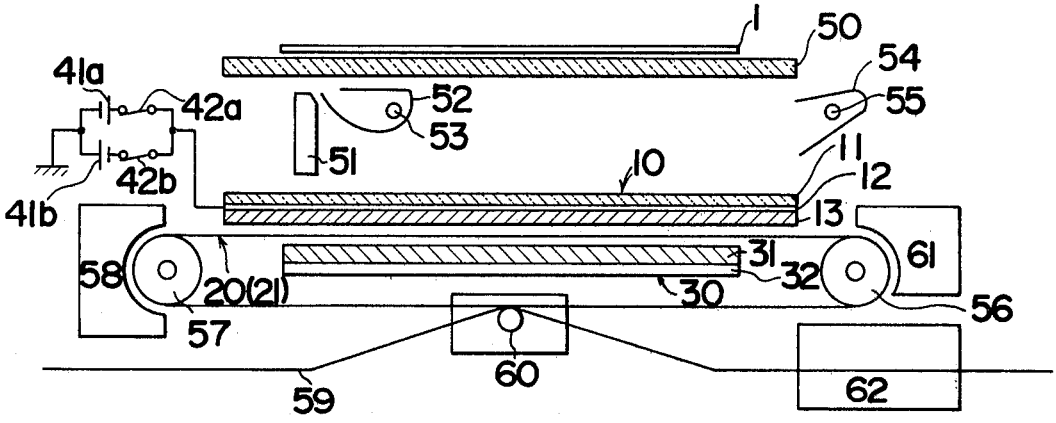
Figure 13:
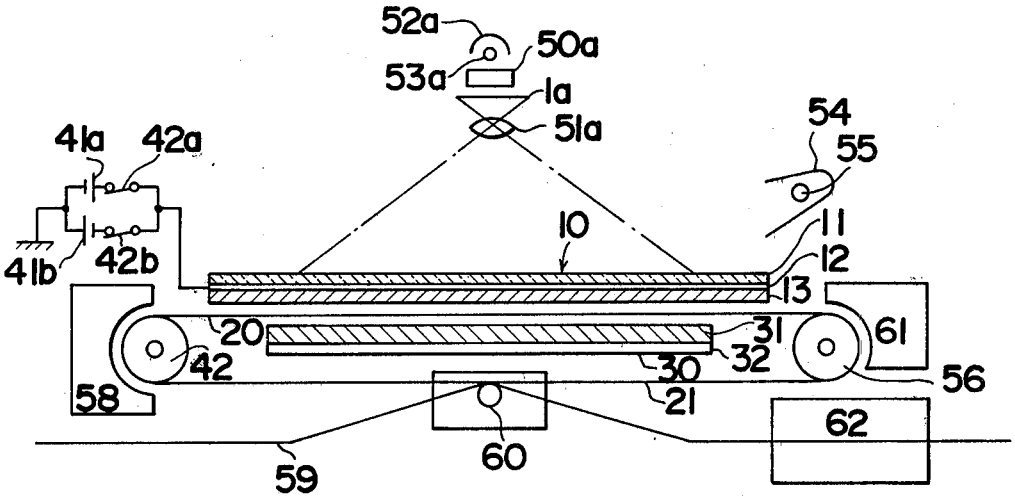

FIGS. *2a* through *2c* are diagrammatic views illustrating electrostatic latent image forming mechanisms for respectively conducting first, second and third steps of the method according to the present invention;

FIG. 3 is an equivalent circuit diagram corresponding to electrostatic latent image forming mechanism shown in FIG. 2;

FIGS. 4 and 5 are graphs showing the theoretical quantitative differences in the transferred potential characteristics of non-illuminated areas between the conventional method and the present method;

FIG. 6 is a graph showing the experimental quantitative differences in the transferred potential charcteristics on non-illuminated areas between the conventional method and the present method;

FIG. 7 is a graph showing the relation between transfer potentials and the illumination intensity of exposure;

FIGS. 8 to 11 are graphs showing the relations between transfer potentials and voltage application times;

FIG. 12 is a diagrammatic view of a copying apparatus employing the method of the present invention and which is particularly suited for producing positive copies from positive originals; and FIG. 13 is a diagrammatic view of another copying apparatus employing the method of the present invention and which is particularly suited for producing positive copies from originals of negative image film.

DESCRIPTION OF THE PREFERRED EMBODIMENTS

Figure 1:
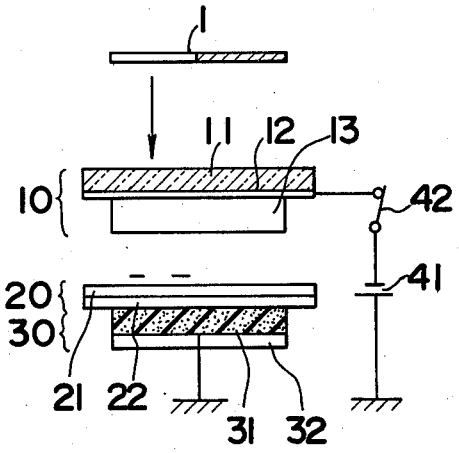
FIG. 1 PRIOR ART
FIG. 1 is a diagrammatic view of the conventional electrostatic latent image forming mechanism employing the simultaneous charge transfer process.

Referring now to FIG. 1, which illustrates an electrostatic latent image forming mechanism employing the simultaneous charge transfer process described in U.S. Pat. Nos. 2,825,814 and 3,502,408, an electro-photographic sensitive or photosensitive member 10 in the form of sheet is held in face-to-face or facewise uniform virtual contact with an electrostatic charge receiving dielectric member 20 (these are shown as remote from each other in the drawings for convenience of illustration). The photosensitive member 10 includes a light transparent glass base 11, an electrode plate 12 of light transparent and electroconductive material such as NESA glass (registered trademark) on said base and a photoconductive layer 13 superimposed thereon. The dielectric member 20 includes a dielectric layer 21 coated on an electroconductive layer 22. It will be noted that the dielectric member 20 may be an electrostatic transfer paper including a dielectric layer coated on an electroconductive base paper or may be in the form of an endless belt for repetitive use.

It is believed that even when the dielectric member and the photosensitive member are held in confronting intimate contact with each other, there exists an air gap of about 5 to 15 microns in average between the two due to their respective surface roughness, non-uniformity in holding them in even contact and for other reasons. Accordingly, the confronting or face-to-face contact between the photosensitive member and the dielectric member will be referred herein as "virtual contact".

The numeral 30 designates a pressure member consisting of pressing plate 32 and electroconductive elastic pad 31 of sponge foam or the like for virtually contacting the dielectric member 20 with the surface of photoconductive layer 13 of photosensitive member 10. The photosensitive member 10 is electrically connected by way of electrode plate 12 to a direct current voltage source 41 through a switch 42 and the dielectric member 20 is electrically grounded through the pressure member 30. An original 1 to be copied is placed on a suitable support (not shown) over the photosensitive member 10 and is exposed to a light source (not shown) and an image thereof is projected by a suitable optical system (not shown). To form an electrostatic latent image on the dielectric member 20, the photosensitive member 10 and the dielectric member 20 are brought into virtual contact and then the switch 42 is closed to apply a direct current voltage of, for example, about 500 to 1000 volts between the electrode plate 12 and the electroconductive elastic pad 31 from the voltage source 41 and simultaneously with this, a light image of exposed original 1 is projected onto the photosensitive member from rear face thereof. In this way, an electrostatic latent image is formed on the dielectric member so that the same may be developed to obtain a positive copy from a negative original.

This simultaneous charge transfer process for forming an electrostatic latent image is generally explained as follows. The application of the voltage to the photosensitive member simultaneously with the exposure thereof to an image of an original causes holes and electrons to be generated in the light illuminated areas within the photoconductive layer 13 thereby causing conduction and polarization in corresponding portions of the photoconductive layer 13. As a consequence, the potential difference in the air gap between the dielectric member 20 confronting the light illuminated portions of the photoconductive layer 13 rises and when this difference exceeds the discharge initiating voltage determined by Paschen Law, air breakdown discharges occur and electrons or ions generated thereby are transferred onto the dielectric member 20. Thus, there is formed a latent image on the dielectric member with charges on the portion corresponding to light illuminated portions of the photoconductive layer.

To obtain an image of high contrast and free of fog by the aforesaid simultaneous charge transfer process, the following measures may be considered. To obtain an image of high contrast, the voltage applied between the photosensitive member and the dielectric member should be set to a high value. On the other hand, in order to obtain an image free of fog the voltage source should be set in such manner that the voltage applied therefrom is insufficient to cause air breakdown discharge in the air gap at non-illuminated portions. Accordingly, it has been a general practice to set the amount or value of the voltage to about 100 volts less than that required to cause air breakdown discharge in the air gap at the non-illuminated portions in order to obtain an image of high contrast and free of fog. However, such a low value of applied voltage causes blurs in the transfer of charges due to the non-uniformity in the air gaps and in consequence, blurs or unevennesses in image density occur particularly in the low density image portions.

As a solution to the above the entire surface of the dielectric member may be precharged to a polarity opposite to that of the electrostatic latent image and thereafter a voltage is applied between the photosensitive member and the dielectric member simultaneously with the exposure thereof to the light image. Such a method is described in U.S. Pat. No. 2,937,943 in which the surface of the dielectric member is precharged by applying a voltage (the polarity of which is opposite to the polarity of voltage applied in the succeeding step in which a voltage is applied simultaneously with exposure to a light image exposure) simultaneoulsy with the full surface illumination thereof to light. However, among the drawbacks of this method are that the intensity of the light exposing the photosensitive member must be highly uniform in order to uniformly charge entire surface of dielectric member, and additionally, the applied voltage, time during which the voltage is applied and the light intensity must be accurately adjusted and maintained in order to always charge the dielectric member to a constant surface potential.

The method of the present invention solves the aforesaid drawbacks and is hereinafter explained with reference to FIGS. 2*a* to 2*c*.

A method for producing or transferring an electrostatic latent image in accordance with the present invention basically comprises three steps, and as shown in FIG. 2*a*, the first step includes applying a direct current voltage between the photosensitive member 10 and the dielectric member 20 in an unilluminated condition (dark condition) with the applied voltage being of a sufficient value to cause air breakdown discharges in the air gap between the face-to-face virtually contacting photosensitive member 10 and dielectric member 20 even under dark or unilluminated conditions. Specifically, in the first step the voltage is applied under dark conditions from a voltage source 41*a* through switch 42*a* to NESA treated electrode plate 12 with the value of the voltage being sufficiently high to cause air breakdown discharges in the air gap between the photosensitive member 10 and dielectric member 20. The time during which the voltage is applied may be as long as the output of source 41*a* permits provided that it is sufficiently a short (for example, less than 0.1 to 0.01 second) such that the dark resistivity of photoconductive layer 13 can be substantially neglected.

By the first step, the full surface of the dielectric layer 21 of charge receiving dielectric member 20 is charged with charges of the same polarity as the applied voltage from source 41*a*. On the other hand, the surface of photoconductive layer 13 is charged to a polarity opposite to that of the applied voltage. The uniform charging of the surface of dielectric member 20 is effected because the applied voltage is sufficiently high to cause air breakdown discharges in the air gap even under dark conditions.

To obtain an equation representing surface potential of dielectric member 20 charged by the first step, the reference is first made to FIG. 3 which shows an equivalent circuit corresponding to the simultaneous charge transfer mechanism shown in FIG. 2. In this figure, $\chi p$, $\chi a$ and $\chi d$ respectively represent the air gap equivalent thicknesses in microns of photoconductive layer 13, the air gap between the virtually contacting photosensitive and dielectric members and of the dielectric member itself. Here, the air gap equivalent thicknesses are obtained by assuming that photoconductive layer 13, the air gap and dielectric layer 21 respectively are dielectrics and the thicknesses of these dielectrics are each divided by their relative dielectric constants. Additionally, the electrostatic capacity (in units of pF/cm$^2$) of the respective dielectrics are determined from $C-885/\chi$. Also, Vap in FIG. 3 represents the applied voltage.

From the afore-described equivalent circuit, the following equation is derived:

$$Vap=(qt/\epsilon o)(\chi p+\chi d)+(q/\epsilon o)(\chi p+\chi d+\chi a) \quad \text{a}$$

$$Vb(\chi a)=Vao+\chi aq/\epsilon o \quad \text{b}$$

Here, Vb ($\chi$a) is the air breakdown discharge initiating voltage in accordance with Paschen Law and that with $\chi$a, it is determined from $312+6.2\chi a$. As to $\epsilon o$, it represents the dielectric constant, qt the amount of charges transferred onto the dielectric member, q the amount of charges induced on the photoconductive layer, air gap and dielectric member and Vao the potential in the air gap prior to the application of voltage:

From equations a and b, $$qt=\frac{\epsilon o}{\chi p+\chi d}\left\{\left(Vap-\frac{\chi p+\chi d+\chi a}{\chi a}Vb(\chi a)-Vao\right)\right\} \quad \text{c}$$

Accordingly, the surface potential $V_T$ of dielectric member 20 charged by the first step is:

$$V_T=\frac{\chi d}{\epsilon o}(qto+qt) = Vto+\frac{\chi d}{\chi p+\chi d}\left\{Vap-\frac{\chi p+\chi d+\chi a}{\chi a}(Vb(\chi a)-Vao)\right\} \quad \text{d}$$

Here, Vto is the initial surface potential of the dielectric member and qto is the initial surface charge density thereof. Since Vao and Vto are respectively zero, $V_T$ at the termination of first step becomes as follows:

$$V_T=\frac{\chi d}{\chi p+\chi d}\left\{Vap-\frac{\chi p+\chi d+\chi a}{\chi a}Vb(\chi a)\right\} \quad \text{(I)}$$

From this equation, I, it can be seen that in order to charge the surface of the dielectric member with some potential, the voltage Vap to be applied should at least be of a value of such that the product of $\chi d/(\chi p+\chi d)$ and Vap is greater than the product of $\chi d/(\chi p+\chi d)$ and $\{(\chi p+\chi d+\chi a)/\chi a\}Vb(\chi a)$.

The second step according to the present invention is to short circuit electrode plate 12 and electroconductive sponge pad 31 and then fully illuminate the photoconductive layer 13 until the electric field therein becomes substantially zero as shown in FIG. 2*b*. This illumination may be effected from rear of photosensitive member 10 in such a manner that light reaches the photoconductive layer 13 to light excite the same so as to generate charge carriers therein. By this, charges on the photoconductive layer 13 are neutralized with the electric field brought to zero. There is no inconvenience or adverse effects even if the amount of illumination is excessive or even if there is an unevenness in illumination as long as the illumination is effected at an amount sufficient to cause the electric field within the photoconductive layer to become substantially zero.

The third step according to the present invention is to expose the photoconductive layer to a light image simultaneously with the application of a voltage between the photoconductive and dielectric members as shown in FIG. 2c. Specifically, in the third step, an original 1 (a negative image) is image exposed onto the photosensitive member and simultaneously therewith, a voltage is applied at a polarity opposite to that of the voltage applied in the first step. By this, holes and electrons are generated in light illuminated areas within the photoconductive layer 13 thereby causing polarization and as the result, air breakdown discharges occur in the air gap in corresponding areas. With the air breakdown discharges, charges on the dielectric member 20 confronting the light illuminated areas are neutralized and charges are transferred thereto. Accordingly, if the polarity of the applied voltage in the first step is positive and negative in the third step, then there will be transferred to the dielectric member with respect to the negative original 1 negative charges at the image areas (illuminated areas) and positive charges on the non-image areas (non-illuminated areas). However, there occurs in practice air breakdown discharges in the air gaps corresponding to non-illuminated areas in this third step as in the first step. To derive the transferred surface potential $V_T$ on the dielectric member 20 at this time, i.e., the surface potential $V_T$ of the non-illuminated areas on the dielectric member 20 at the termination of the third step, the following relationship is applied.

$$Vao = \frac{-\chi a}{\chi a + \chi d} Vto \qquad e$$

From equations d and e, the following is derived:

$$V_T = Vto + \frac{\chi d}{\chi p + \chi d}\left\{\left[Vap - \frac{\chi p + \chi d + \chi a}{\chi a}\left(Vb\,(\chi a) + \frac{\chi a}{\chi a + \chi d} Vto\right)\right]\right\} \qquad \text{(II)}$$

In this equation II, Vto should be regarded as $V_T$ of equation I. As will further become apparent from the following description, the maximum allowable value of the voltage Vap applied in the third step without causing fog is when $V_T$ of equation II becomes zero.

While the foregoing description has been directed to the first to the third steps, the equation for the surface potential $V_T$ of the non-illuminated areas on the dielectric member 20 at the termination of the third step in the absence of the second step (i.e., with the amount of illumination being zero) will be shown for comparison purposes. In this connection $$V_T = Vto + \frac{\chi d}{\chi p + \chi d}\left\{Vap - \frac{\chi p + \chi d + \chi a}{\chi a}\left(Vb\,(\chi a) + \frac{\chi a\,(\chi p + \chi d)}{\chi d\,(\chi p + \chi d + \chi a)} Vto\right)\right\} \qquad \text{(III)}$$

Reference is now be made to the transfer potential characteristic curves shown in FIG. 4 to explain the quantitative differences between the method according to the present invention and that of the conventional method. In FIG. 4, the vertical axis designates the transferred surface potential of non-illuminated areas on the dielectric member at the termination of step wherein a light image is projected simultaneously with the application of a voltage and the horizontal axis designates the applied voltage at the time of exposure of the photosensitive member to the light image. It will be noted that the averages of $\chi p$, $\chi d$ and $\chi a$ were respectively determined as 3.8, 1.2 and 6.5 and that the polarity of the applied voltage was set to be negative.

According to the conventional method wherein dielectric member is not precharged but rather an electrostatic latent image is formed by the step shown in FIG. 1, the condition for the applied voltage Vap is determined by theoretical curve A calculated by equation I. It should be noted that the reason why equation I which was described in connection with the first step of the present invention can be applied to the conventional method is because air breakdown discharges take place in the dark in both methods. From curve A, it can be seen that the absolute value of the applied voltage must be set less than 620 volts in order to obtain a copy without fog in the background only by the step shown in FIG. 1. In other words, the air breakdown discharges will occur in the air gaps of the non-illuminated areas if the applied voltage is set at a value greater than −620 volts thereby causing charges to be transferred onto the background areas of the dielectric member which appear as fog when developed.

In the steps shown in FIGS. 2a to 2c and in the case wherein the second step was omitted to perform the third step following the first step, then the theoretical curve C calculated by the equation III is drawn. Here, the potential $V_T$ transferred onto the surface of the dielectric member by the application of voltage in the first step is assumed to be 80 volts. What should be observed in this curve C is that the transferred potential onto the dielectric member perfectly coincides with the theoretic curve A in the negative region. This indicates that the method without the second step requires the absolute value of applied voltage to be less than 620 volts similar to that in aforesaid conventional methods thereby demonstrating that there is no improvement whatsoever.

On the contrary, the theoretical transfer characteristic according to the present invention is represented by the curve B (transferred surface potential $V_T$ is assumed to be 80 volts). From this result, it is observed that a copy of high contrast and free of fog in background areas can be obtained even if the absolute value of applied voltage is increased to 830 volts. Thus, the applied voltage may further be increased by increasing the transferred surface potential onto the dielectric member in the first step.

While the above description has been made to obtain a reversal or a positive copy of from a negative original (e.g., negative film), the present invention is applicable to obtain a positive copy of a positive original. In this case, illuminated areas and non-illuminated areas in the above description will merely be opposite, that is, the illuminated areas will be non-image portions whereas non-illuminated areas will be image portions with respect to positive original.

To be more specific, the equation II can be applied to positive copying and this will be explained by transferred potential characteristic curves shown in FIG. 5. In the calculations, $\chi p$, $\chi d$ and $\chi a$ were assumed to be the same as in the case of FIG. 4. In FIG. 5, D1, D2, D3 and D4 are curves representing the theoretical transfer characteristics of the method of the present invention and were derived from equation II with the transferred potential charged by the first step assumed to be 80 volts, 100 volts, 120 volts and 140 volts for respective curves D1, D2, D3 and D4. On the other hand, the theoretical curve E designates the transfer characteristic calculated from equation III in which the second step was omitted. Comparing the curves D1 and E where the precharged potential is 80 volts, the maximum voltage Vap which can be applied in the third step is −830 volts for the former and only −620 volts for the latter. Additionally, if the voltage applied in the third step was set to −500 volts, then the transferred potential of dark areas (non-illuminated areas) according to curve E would be 30 volts whereas it would be 80 volts for curve D1. This apparently assures that a high contrast image is obtained by the method in accordance with the present invention. Furthermore, the same conclusions may be drawn for theoretical curves D2, D3 and D4 wherein the maximum allowable voltage to be applied in the third step is about −880 volts, −940 volts and −1000 volts respectively. Accordingly, an image of high contrast without fogging can be formed by suitably setting the value of applied voltage in the third step.

In the development of the electrostatic latent image which is effected after the third step, any developer may be used. For example, the latent image may be developed by a toner having polarity opposite to the latent image or by a mono-component toner. In the case of use of a mono-component toner, the potential of the non-illuminated areas should be sufficiently low compared to potential of illuminated areas.

EXAMPLE 1

The photosensitive member 10 included a photoconductive layer 13 of about 30 microns thick superimposed on an electroconductive layer 12 which in turn was formed by the NESA treatment of the surface of glass plate of 5 mm thickness. The photoconductive material of layer 13 is a photoconductive powder of $Cds.nCdCO_3$ ($0.8 \leqq n \leqq 1$) which together with a metallic activator is dispersed in an acryl binder resin. The capacitive air gap equivalent thickness $\chi p$ of this photoconductive layer 13 was determined to be 3.8. As the dielectric member 20, an electrostatic transfer paper was employed which included a dielectric layer 21 coated over an electroconductive treated base paper 22 manufactured by Crown Zellerbach Co. Its capacitive air gap equivalent thickness $\chi d$ was 1.2. As to $\chi a$, the average capacitive air gap value was determined to be 6.5. A negative microfilm was used as to the original to be copied.

The photosensitive member 10 and transfer paper 20 are brought into face-to-face virtual contact with one another in the manner shown in FIG. 1, and then voltage was applied to the electroconductive layer 12 with amount thereof varied stepwise in the range of 0 to −1100 volts while it is exposed to a light image in order to observe the transferred potential characteristic onto the paper 20. The time during which the voltage was applied at each step was 0.1 second. The measured results are plotted in FIG. 6 by the square marks. From the results, it can be seen that maximum allowable applied voltage without causing fogging is about −600 volts and the transferred potential characteristic curve thereof follows substantially identically the theoretical curve A shown in FIG. 4.

Next, the transfer characteristics according to the method of the present invention were determined. The experiment was conducted, with the photosensitive member 10 and transfer paper 20 held in virtual contact with each other, by applying a direct current voltage of 910 volts under dark or un-illuminated conditions to the electroconductive layer 2 to uniformly charge the surface of paper 20 (this step corresponds to the first step), and then by effecting full illumination of the rear of photosensitive member 10 at an exposure intensity of 970 lux for 0.5 seconds to bring the electric field within the photoconductive layer 13 to substantially zero (this step corresponds to the second step), and finally applying a direct current voltage to the electroconductive layer simultaneously with the exposure thereof to a light image (this step corresponds to the third step). Each of these steps were repeated with the amount of applied voltage varied stepwise from 0 to −1100 volts. The measured transfer potentials are plotted by the triangular marks as shown in FIG. 6. From this, it can be seen that the surface of the transfer paper is charged to a surface potential of about 80 volts and that when the amount of voltage applied in the third step exceeds over −500 volts, transfer of charges in the air gap corresponding to non-illuminated areas begins to take place thereby neutralizing charges previously charged. Only when the applied voltage in the third step exceeds over about −800 volts are charges completely neutralized and air breakdown discharges in the air gap of non-illuminated areas occur to transfer charges of negative polarity onto the transfer paper which becomes the cause of fogging. Thus, the maximum allowable applied voltage without causing fogging is increased to as much as about −800 volts and the characteristic curve thereof is substantially the same as the theoretical curve B shown in FIG. 4. Accordingly, there is formed a latent image of better contrast on the transfer paper corresponding to the light illuminated areas since the amount of voltage applied is increased as compared with the conventional method.

Experiments similar to the above experiments according to the method of the present invention but with the second step omitted were conducted to examine the transfer characteristics under such conditions. Specifically, under the same conditions as above, a voltage of 910 volts was first applied under conditions of darkness which step is identical to the first step and immediately thereafter, a voltage was applied simultaneously with exposure to a light image which is a step corresponding to the third step. Each of these steps were repeated with the value of the applied voltage in the latter step varied stepwise. The measured transfer potentials onto the transfer paper corresponding to the image dark or non-illuminated areas are shown in FIG. 6 by the cross marks. The resulting curve is substantially the same as the theoretical curve C of FIG. 4 and shows that the voltage applied in the third step must be less than about −600 volts in order to form a latent image free of fog. This is no improvement over the conventional method shown in FIG. 1 since it also requires that the applied voltage be less than −600 volts. Thus, it can be concluded that the second step is a requisite in the method of the present invention.

To determine the amount of exposure necessary for the second step of full surface illumination, the voltage applied to a lamp for the purpose of full surface illumination was adjusted to vary the illumination intensity with the voltage applied in the third step set to −850 volts. The illumination intensity was varied in the range of about 0.1 to 1000 lux. The relationship between the illumination intensities and the transferred surface potentials of non-illuminated areas onto the transfer papers is shown in FIG. 7. From this, it can be seen that transfer potentials level off at an illumination intensity of about 100 lux and collating this fact with measured results shown by the triangle and cross marks of FIG. 6, it was confirmed that an image of high contrast and free of fog is obtained with an amount of exposure greater than about 50 lux-seconds (i.e., 100 lux×0.5 second) in the second step.

EXAMPLE 2

Figure 10:
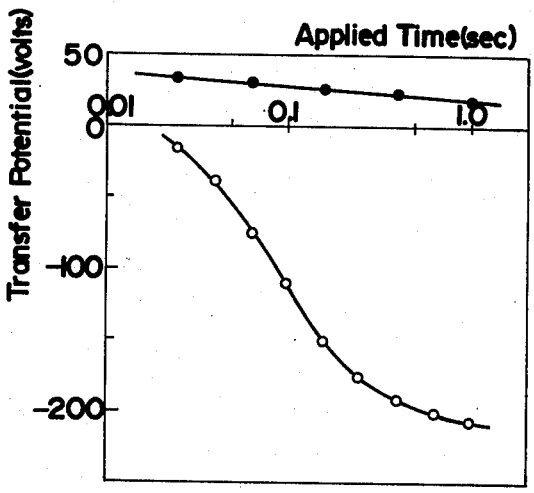

With reference to the experimental results of Example 1, further experiments were conducted to observe the images actually formed by the conventional method and by the present method. The same original, photosensitive member and transfer paper as in Example 1 were used and the light intensity onto the photosensitive member at the time of exposure of the original was set to 192 lux. For developing the electrostatic latent image formed on the transfer paper, four pairs of metallic rollers each having a diameter of 16 mm and arranged in parallel were used. All the pairs of metallic rollers are immersed in a developing liquid and transport the transfer paper at a speed of 10 cm/sec therethrough. As the liquid developer, positively charged toner under the trade name of DIC-05 manufactured by Dainihon Ink Company was used. Along with the image forming experiments, measurements were made on the relation between the voltage applied time and the transferred surface potentials of the illuminated and non-illuminated areas on the transfer paper. FIGS. 8 to 10 show the measured results wherein the vertical and horizontal axes respectively represent the transferred surface potential of the transfer paper and the voltage applied time with the empty circular marks being the measured potentials of the illuminated areas and the filled circular marks being the measured potentials of the non-illuminated areas.

In an experiment following the conventional method shown in FIG. 1, the voltage to be applied to the electrode plate 12 while the photosensitive member is exposed to the image of an original is set to −550 volts by taking into consideration the results of Example 1 shown in FIG. 6 by the square marks since a voltage exceeding −600 volts will cause charges to be transferred on portions of the transfer paper corresponding to non-illuminated areas. The times during which the voltages are applied are varied stepwise from 0.04 to 1.0 second to form a number of electrostatic latent images and each of the images on the transfer papers were developed. As a result, a copy of highest image density without any fog was obtained at a voltage applied time of 0.16 second. However, its highest image density is still somewhat low and there was unevennesses in the density on the low density portions. The latent image transfer characteristic shown in FIG. 8 indicates that the transfer potential of an illuminated area at an exposure amount of 192 lux×0.16 second was measured to be about −100 volts.

The same experiments as above were repeated but with voltage to be applied set to −650 volts. As may be obviously assumed from the results of Example 1 shown by the square marks in FIG. 6, charges were transferred at non-illuminated areas regardless of the voltage applied time from 0.4 to 1.0 second as shown by the filled circular marks in FIG. 9. However, the maximum image density is sufficiently high at a voltage applied time exceeding 0.1 second and that unevennesses in image density in low density portions was hardly observed although there was heavy fog in background area.

Lastly, experiments according to the method of the present invention were conducted. The applied voltage in the first step was set to +800 volts with the time during which the voltage was applied being set to 0.1 second. An amount of exposure for full surface illumination of second step was set to 360 lux×0.5 second and the applied voltage in the third step was set to −650 volts. Each of these first to third steps were repeated with the voltage applied time in the third step being varied stepwise from 0.04 to 1.0 second to form a number of latent images on the transfer papers. Each of these transfer papers was then developed. No fogging in the background areas was observed on any of the developed images and in particular, the best quality image, high in image density and free of fog and yet with no density unevennesses in the low density portions was obtained at a voltage applied time of 0.16 second. As shown in FIG. 10, the transfer potential at 192 lux×0.16 second was about −150 volts. It should be noted from FIG. 10 that the transfer potentials at the non-illuminated areas are all in the positive range at voltage applied times of 0.04 to 1.0 second as shown by the filled circular marks. Thus, the method of forming a latent image in accordance with the present invention assures the formation of a copied image of high contrast and free of any fog.

EXAMPLE 3

Figure 11:
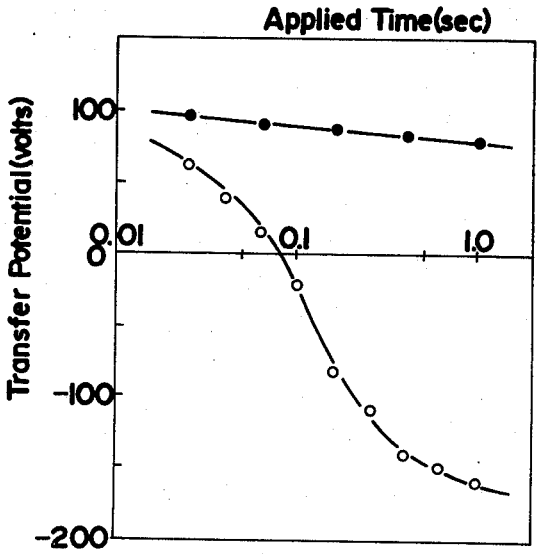

This example relates to experiments for forming positive images of an original. In the first step, a voltage of +1200 volts was applied for 0.1 second to precharge the transfer paper to a surface potential of about −135 volts. The second step of full surface illumination was conducted at an illumination intensity of 970 lux for about 0.5 seconds. And in the third step, a voltage of −600 volts was applied simultaneously with exposure to an original bearing positive image at the amount of exposure set to 192 lux. Each of these steps were repeated with the voltage applied time in the third step being varied stepwise from 0.04 to 0.1 second to determine the transferred potentials, the results of which are shown in FIG. 11. With each transfer paper developed by the magnetic brush method using a mono-component toner, it was established that at voltage applied times of less than 0.1 second, charges at the background areas (illuminated areas) were not completely neutralized so that fogging appeared. However, at an applied time of 0.1 second, a copy of high contrast and free of fog was obtained with the transferred potentials of non-illuminated areas (image portions) being as high as 90 volts and −20 volts at illuminated areas.

From the foregoing, it becomes clear that in accordance with the present invention, (1) the surface potential to which the transfer paper is charged may always be maintained constant by merely setting the value of the applied voltage; (2) the time during which the voltage is applied may be any time as long as it is short enough (about 0.01 to 0.1 second) such that the dark resistivity of the photoconductive layer can be substantially neglected; (3) for full surface uniform illumination, it is only required that the amount of exposure be sufficient to bring electric field within the photoconductive layer down to substantially zero and that the adjustment or elimination of uneven illumination is not a requisite; and (4) a copied image of fine quality, high in image density, with no unevennesses and free of any fogging can be obtained.

Referring now to FIG. 12 which illustrates a specific construction of a copying apparatus employing the method in accordance with the present invention there is shown a slit exposure type copying apparatus for producing a positive image from an original with a positive image, in which the original 1 in the form of sheet or book is placed on a transparent original support plate 50 and therebelow, there is provided a reciprocatingly movable unit including an image transmitter 51 comprising a bundle of optical fibers of graded refractive index and an image exposure lamp 53 backed by a reflecting member 52. The image transmitter 51 together with the lamp 53 is moved for scanning of an image in a plane parallel to the original 1 and then returns upon completion of the scan to its initial position for the next scan. Reference is made to U.S. Pat. No. 3,955,888 as an example of a specific means for moving the image transmitter 53 for scanning. In the vicinity of a terminal end of the scanning path of image transmitter 51, there is provided a light source 55 backed by a reflecting member 54 for use in the second step of full surface illumination.

The photosensitive member 10 in a form of sheet, as has been heretofore described, comprises a light transparent glass plate 11, a light transparent and electroconductive NESA electrode plate 12 and a photoconductive layer 13 and is disposed parallel to the original support plate 50. The NESA electrode plate 12 is connected to voltage sources 41*a* and 41*b* through normally open switches 42*a* and 42*b*. Voltage source 41*a* is energized to supply to the electrode plate 12 a voltage of positive polarity in the first step and another source 41*b* is for the supply thereto of a voltage of negative polarity in the third step. As has been explained, the electrode plate 12 is electrically grounded in the second step by any suitable means.

The electrostatic charge receiving dielectric member 20 is in the form of a flexible endless belt rotatably supported by a pair of longitudinally spaced rollers 56, 57 and comprises a dielectric layer 21 overcoated on an electroconductive rubber sheet or electroconductively treated Mylar film. As the material for the dielectric layer 21, an acryl resin, Mylar film or other similar material may be used and should preferably have a thickness of about 3 to 5 microns. The dielectric member 20 is normally stationary and pressed against the surface of photoconductive layer 13 by pressure means 30 consisting of an electroconductive sponge pad 31 over a pressing plate 32. The dielectric member 20 is electrically grounded through the sponge pad 31 or through rollers 56, 57. As has been described, it is believed that there exists an air gap of about 5 to 15 microns in average between the dielectric member 20 and photosensitive member 10 even if they are uniformly intimately contacted due to their surface roughnesses and unevennesses.

Provided around the the dielectric member 20 the form of an endless belt are a developing means 58 for developing an electrostatic latent image, an image transferring means 60 for transferring the developed image onto a plain copying paper 59 suitably fed thereto and a cleaning means 61 for removing and erasing residual toner and charges remaining on the dielectric member. Also along the path of copying paper 59, there is provided a fixing means 62 for fixing transferred image. The aforesaid means 58, 59, 60 and 61 may be of any suitable or conventional construction.

In operation, the original 1 to be copied is placed on the original support plate 50 and then the dielectric member 20 is brought into virtual contact with the photosensitive member 10. Upon actuation of a print switch (not shown), first switch 42*a* is closed to apply voltage of positive polarity, for example of 1200 volts, between the photosensitive member 10 and dielectric member 20 from voltage source 41*a* connected through switch 42*a* to the electrode plate 12. This application of a voltage is effected in the dark and air breakdown discharges consequently occur in the air gap between the photosensitive and dielectric members to uniformly charge the surface of dielectric member 20. Following this, the photosensitive member 10 is electrically grounded to thereby be shorted to the electroconductive backing of dielectric layer 21 and then the light source 55 is energized to effect full surface illumination of photosensitive member 10 from the rear thereof until the electric field within the photoconductive layer 13 is brought down substantially to zero. Immediately thereafter switch 42*a* is opened and switch 42*b* is closed to apply voltage of negative polarity to the photosensitive member 10 relative to dielectic member 20 from voltage source 41*b*. Simultaneously therewith, the exposure lamp 52 is energized and the image transmitter 51 together with the lamp 53 is moved to the right in a direction parallel to the original support plate 50 to successively scan the image of original 1. By this, an electrostatic latent image is formed on the dielectric member 20. Switch 42*b* is opened and thereafter the pressing means 30 urging the dielectric member 20 into virtual contact with the surface of photoconductive layer 13 is released to separate the member 20. Simultaneously, the rollers 56, 57 are driven to move the dielectric member 20. As the member 20 is advanced, the latent image formed thereon is developed with toner by developing means 58 and then transferred to copying paper 59 by image transferring means 60. The paper is fed thereafter to fixing means 62 to become permanent copy. On the other hand, the dielectric member 20 is cleaned and residual toner and charges remaining thereon are erased by means 61. The rollers 56 and 57 are then deenergized to stop the dielectic member 20 for next copying operation.

The apparatus shown in FIG. 13 is basically the same as that shown in FIG. 12 but particularly suited for producing a positive image from an original of negative film. In the present apparatus, an original in the form of film is placed between a condenser lens 50*a* and a projection lens 51*a* and illuminated so that a light image thereof is projected onto the photosensitive member 10 by an exposure lamp 53*a* backed by reflecting member 52. The operation of the apparatus to form an electrostatic latent image is basically identical as the apparatus of FIG. 12 and the same reference numerals are used to designate similar parts so that a detailed explanation of operation of FIG. 13 is not necessary.

While there have been described preferred embodiments of the present invention, it is apparent that numerous alterations, additions and omissions may be made without departing from the spirit thereof.

We claim:

1. A method for forming an electrostatic image on a charge receiving dielectric member held in face-to-face contact with a photosensitive member which comprises the steps of:

applying a direct current voltage between the photosensitive member and the dielectric member under dark conditions to cause air breakdown electrical discharges therebetween;

electrically interconnecting the dielectric and photosensitive members and simultaneously illuminating the photosensitive member until the electric field within the photosensitive member becomes substantially zero; and applying a direct current voltage of opposite polarity between the photosensitive member and the dielectric member simultaneously with the exposure of the photosensitive member to an image of an original.

2. A method for forming an electrostatic latent image on an electrostatic charge receiving dielectric member maintained in virtual contact with a photosensitive member which comprises the sequential steps of:

applying a direct current voltage of a first polarity between the photosensitive member and the dielectric member under dark conditions and of a value sufficient to cause air breakdown discharges therebetween to charge the surface of the dielectric member;

short circuiting the photosensitive member and dielectric member and simultaneously effecting full surface illumination of the photosensitive member until the electric field within the photosensitive member becomes substantially zero; and applying a direct current voltage of a polarity opposite to said first polarity between the photosensitve member and dielectric member simultaneously with the exposure of the photosensitive member to an image of an original.

3. A method for forming an electrostatic latent image on an electrostatic charge receiving dielectric member maintained in face-to-face virtual contact with a photosensitive member which comprises the sequential steps of:

applying a direct current voltage of a first polarity between the photosensitive member and dielectric member under dark conditions, said voltage being of sufficient value to cause air breakdown discharges in the air gap between said members whereby to charge the surface of the dielectric member with charges of a first polarity, said photosensitive member including a photoconductive layer on a light transparent electrode layer with said photoconductive layer being photoconductive to both positive and negative polarities, and said dielectric member including a dielectric layer formed on an electrically conductive layer;

short circuiting said photosensitive member and dielectric member and effecting full surface illumination of said photoconductive layer from the side of said electrode layer until the electric field in the photosensitive member becomes substantially zero; and applying a direct current voltage of a polarity opposite to said first polarity between the photosensitive member and dielectric member and exposing an image of an original onto said photoconductive layer from the side of said electrode layer simultaneously therewith.

4. In a method for forming an electrostatic latent image on an electrostatic charge receiving dielectric member held in virtual contact with a photosensitive member wherein said dielectric member includes a dielectric layer formed on an electrically conductive layer and said photosensitive member includes a photoconductive layer on an electrode layer, the sequential steps including:

a first step of applying a direct current voltage of a first polarity between the photosensitive member and the dielectric member under dark conditions thereof and of a value sufficient to cause air breakdown discharges in the air gap between said photosensitive and dielectric members to charge the surface of the dielectric member with charges of a first polarity to a surface potential $V_{T1}$ substantially equal to $$\frac{\chi d}{\chi p + \chi d}\left\{\left[Vapl - \frac{\chi p + \chi d + \chi a}{\chi a} Vb\,(\chi a)\right]\right\}$$

wherein $\chi p$, $\chi d$ and $\chi a$ are the air gap equivalent thicknesses in microns of said photoconductive layer, dielectric layer and air gap respectively; Vb ($\chi a$) being the air breakdown discharge initiating voltage in accordance with Paschen Law and in the relationship of $312+6.2\,\chi a$ with $\chi a$; and Vap1 is the voltage applied in the first step in which the value of Vap1 is such that product of $\chi d/(\chi p+\chi d)$ and Vap1 is greater than the product of $\chi d/(\chi p+\chi d)$ and $\{(\chi p+\chi d+\chi a)/\chi a\}$ Vb ($\chi a$);

a second step of effecting a full surface illumination of said photosensitive member with said photosensitive member and dielectric member short-circuited until the electric field in the photosensitive member becomes substantially zero; and a third step of applying a direct current voltage of a polarity opposite to said first polarity between the photosensitive member and the dielectric member simultaneously with the exposure of the photosensitive member to an image of an original, the surface potential $V_{T2}$ of the dielectric member at the portions thereof corresponding to non-exposed areas at the termination of the third step being substantially equal to $$V_{T1} + \frac{\chi d}{\chi p + \chi d}\left\{Vap2 - \frac{\chi p + \chi d + \chi a}{\chi a}\left(Vb\,(\chi a) + \frac{\chi a}{\chi a + \chi d} V_{T1}\right)\right\}$$

wherein Vap2 is the voltage applied in the third step and the maximum value of Vap2 applied without causing fog is when the aforesaid equation is equal to zero.

5. A method for forming a copy of an original which comprises a first step of virtually contacting an electrostatic charge receiving dielectric member with a photosensitive member, said dielectric member including a dielectric layer formed on an electrically conductive layer and said photosensitive member including a photoconductive layer on a light transparent electrode layer with said photoconductive layer being photoconductive to both positive and negative polarities;

a second step of applying a direct current voltage of a first polarity between the photosensitive member and the dielectric member under dark conditions wherein the applied voltage is of sufficient value to cause air breakdown discharges in the air gap between the photosensitive and dielectric members to charge the surface of the dielectric member with charges of a first polarity;

a third step of short circuiting said photosensitive member and said dielectric member and simultaneously effecting the illumination of the photosensitive member to reduce the electric field within the photosensitive member to substantially zero;

a fourth step of applying a direct current voltage of a polarity opposite to said first polarity between the photosensitive member and the dielectric member simultaneously with the exposure of the photosensitive member to an image of an original to form an electrostatic latent image on the dielectric member;

a fifth step of developing the latent image with toner; and a sixth step of transferring the developed image onto a copy paper and then fixing said transferred image.

6. The method as claimed in claim 5 wherein said dielectric member is in the form of endless belt and further comprising the step of cleaning and erasing residual toner and charges from said belt after said sixth step.

7. The method of producing an electrostatic latent image in which there are employed a photosensitive member including a photoconductive layer superimposed on a first conductive electrode and a dielectric member including a dielectric layer superimposed on a second conductive electrode comprising the steps of positioning said members with said layers in face-to-face contact, applying between said electrodes while said photoconductive layer is unilluminated a voltage of a first polarity and of a value sufficient to establish gaseous discharges in the gap between said contacting layers, thereafter electrically interconnecting said electrodes while exposing said photoconductor layer to light to bring said electrodes to a substantially equal potential until the electric field across said photoconductive layer is substantially zero and thereafter simultaneously exposing said photoconductor layer to a light image and applying between said electrodes a voltage of a polarity opposite to said first polarity to form an electrostatic latent image corresponding to said light image on said dielectric layer.

8. The method of claim 7 wherein said members are maintained with said layers in face-to-face virtual contact during the application of voltages between and during the electrical interconnection of said electrodes.

9. The method of claim 8 wherein said electrodes are interconnected by short circuiting said electrodes.

10. The method of claim 8 wherein said second electrode comprises an electrically conducting paper on a face of which said dielectric layer is coated and further comprising the steps of developing said latent image and then fixing the developed image.

11. The method of claim 8 further comprising the steps of separating said members, developing the latent image on said dielectric layer, transferring said developed image to a copy paper and thereafter fixing said transferred developed image.

12. The method of charging the surface of a dielectric comprising the steps of positioning said dielectric backed by a conductive electrode in separable face-to-face virtual contact with a photoconductor backed by an electrode, applying between said electrodes while said photoconductor is substantially unilluminated a dc voltage of a value sufficient to establish a gaseous electric discharge between the confronting faces of said dielectric and photoconductor and discontinuing the application of said voltage and simultaneously with the illumination of said photoconductor interconnecting said electrodes to effect the flow of current through said photoconductor until said flow is substantially zero.

13. The method of claim 12 wherein said interconnecting of said electrodes is effected by mutually short circuiting said electrodes to bring them to an equipotential.

* * * * *